United States Patent [19]

Gerrish

[11] 3,956,838

[45] May 18, 1976

[54] PICTURE FRAME

[75] Inventor: Charlene E. Gerrish, Danville, Calif.

[73] Assignee: Sunset Designs, Inc., Concord, Calif.

[22] Filed: June 17, 1974

[21] Appl. No.: 479,870

[52] U.S. Cl. ..... 40/154

[51] Int. Cl.[2] ..... G09F 1/12

[58] Field of Search ..... 161/18, 159; 428/13, 428/14, 310, 158; 40/152, 154; 52/716

[56] References Cited

UNITED STATES PATENTS

| | | | |
|---|---|---|---|
| 908,482 | 1/1909 | Morton | 40/154 |
| 2,428,242 | 9/1947 | Propst | 40/158 |
| 2,458,349 | 1/1949 | Cross | 40/154 |
| 3,274,721 | 9/1966 | Dreyer | 40/152 |
| 3,758,358 | 9/1973 | Kuroda | 40/160 X |

FOREIGN PATENTS OR APPLICATIONS

| | | | |
|---|---|---|---|
| 758,864 | 11/1933 | France | 40/154 |

*Primary Examiner*—Hugh R. Chamblee
*Assistant Examiner*—Wenceslao J. Contreras

[57] ABSTRACT

A picture frame and process for the manufacture thereof comprising a relatively stiff base material such as a composite chip board covered with a layer of resilient form thereover and a cloth fabric. The fabric is stretched and secured to the back of the base member and affixed around the outside dimensions as well as the inside dimensions.

The frame is supplied with an adhesive which can be a two faced adhesive tape on either side for adhesion to the base as well as interfacing the fabric to be secured thereto. The adhesive can be prepositioned on the frame member, such that a release paper can be removed and the frame wrapped with the outer fabric at a subsequent time for securement thereto.

The foregoing frame is adapted to receive a picture and a backing thereover for exposure through the interior portion of the frame.

6 Claims, 5 Drawing Figures

PICTURE FRAME

BACKGROUND OF THE INVENTION

1. Field of the Invention

The field of this invention lies in the artistic framing art. Specifically, the field relates to the framing of artistic works such as pictures, photographs, stitchery and needlework.

2. The Prior Art

Artistic frames of the prior art have generally comprised wooden, metal, fiber, and other frames that have been formed out of four members or a circular structure. The main criteria is that the frame encompass the object to be framed and provide an aesthetically appearing surface of the border or periphery thereof.

Such frames have been finished with paint, lacquer, gold gilt, and in some cases, velvet and cloth. However, in most instances, the frames had to be built up or made as custom frames for specific pictures or photographs.

Recently, it has been popular to make needlework and stitchery creations. After the artistic creation has been made, it is oftentimes desirable to frame it within a frame having suitable and/or matching outside borders. To this end, the matching borders have been provided by various means, including cloth and velvet. However, in all cases, the frame has not been capable of being easily assembled. Furthermore, it does not provide a soft, aesthetically appealing frame for a picture.

The instant invention provides a frame with a substantially improved cloth cover over a resilient, smooth and rounded material, such as a foam. The entire frame can be made by a person doing the artistic creation such as those who practice arts and crafts in their home.

The frame is particularly enhanced by virtue of the ease and adaptability with which one having limited manual skills can assemble the frame. The entire package can be sold with the cloth covering matching the particular work which is to be framed thereby. In other words, oftentimes the stitchery or other work is such that it has a particular background or coloration. To this end, the outside frame and its cloth background material can be such that it matches the object to be framed thereby.

As will be understood, this invention has broad application and is a substantial enhancement over the prior art, inasmuch as it provides many of the foregoing features, as well as those which will be enunciated in the following specification.

SUMMARY OF THE INVENTION

In summation, this invention comprises a frame that can be easily assembled by one practicing arts and crafts at home. At the same time, it provides an aesthetically appealing frame having a soft surrounding foam-like cloth cover.

More specifically, the frame of this invention incorporates a frame base, a foam overlayment, and a fabric which overlies the foam and is secured within and behind the frame. The frame is adapted to receive a picture with a backing thereover, providing the pleasant appearance of a frame having a cloth cover.

The entire frame can be assembled from the components of a fabric that has been precut, foam, a chip board, and a multisurfaced adhesive on a tape that has release paper on either side. The adhesive can be pre-applied to the board, or can be provided with release paper on both sides and applied by an artisan during the assembly of the frame.

BRIEF DESCRIPTION OF THE DRAWINGS

The invention will be more clearly understood by reference to the description below taken in conjunction with the accompanying drawings wherein.

DESCRIPTION OF THE PREFERRED EMBODIMENTS

Figure 1:
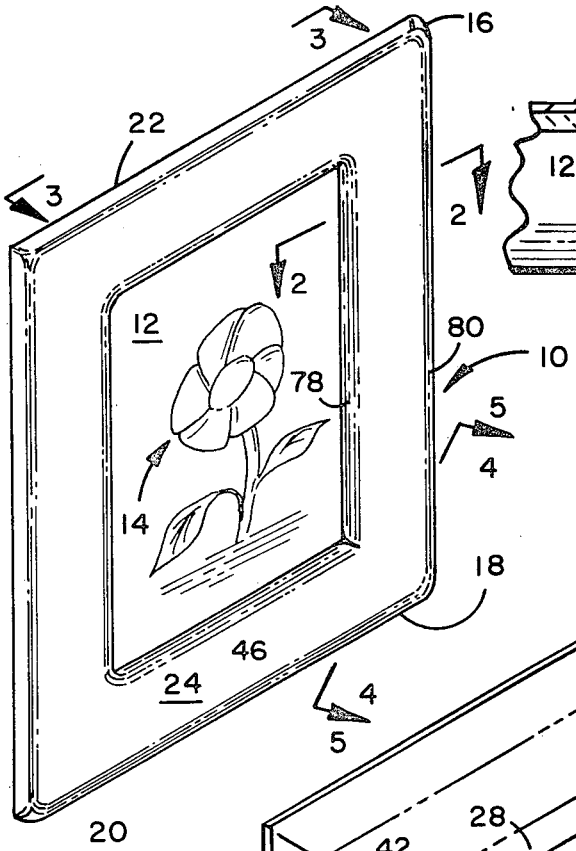
FIG. 1 shows a perspective view of the frame of this invention with a picture in the opening thereof.

Looking more particularly at the Figures, it can be seen that FIG. 1 is a perspective view of the frame with an artistic rendering therein. The artistic rendering can be of needlework or a stitchery pattern. Specifically, as can be seen, a frame 10 encloses an art rendering 12. The art rendering 12 has a flower 14 with leaves thereon. It is a stitchery pattern that has been provided by a pre-established pattern on a backing, or from an arts and crafts manual.

The frame 10 has rounded corners 16, 18, 20 and 22. The rounded corners 16, 18, 20 and 22 are formed by the resilient nature of an underlayment which will be described.

The frame 10 incorporates a cloth material 24 at its outer portion. The cloth material 24 can match the general background of the artistic work 12, or can be of any other suitable type. The cloth cover can be formed of a textile, woven, or knitted material.

Figure 3:
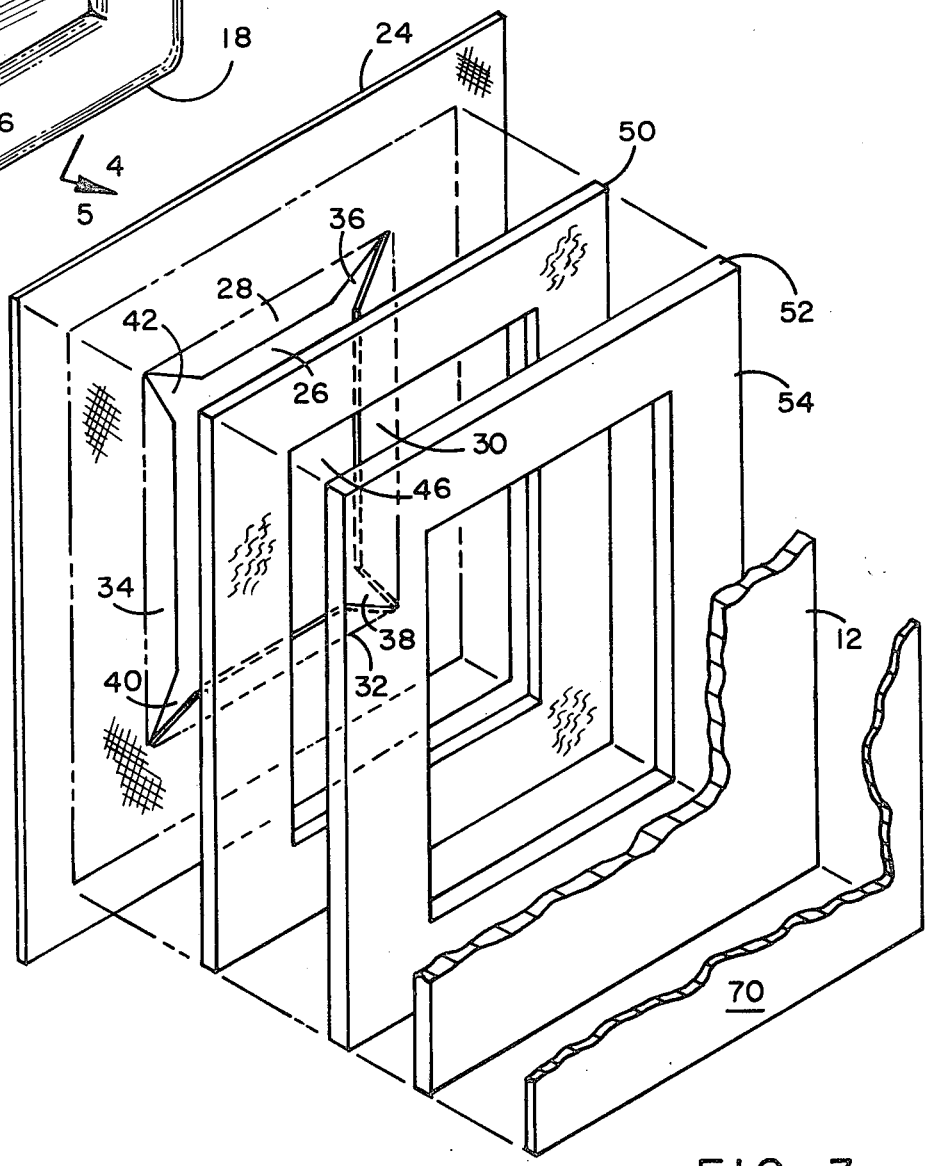
FIG. 3 shows an exploded view of the frame components in their unassembled form in the direction of lines 3—3 of FIG. 1.

The cloth cover 24 is shown in greater detail in FIG. 3 prior to the time it is laid out. As seen in FIG. 3, the cloth material 24 has an interior opening 26 with tabs 28, 30, 32 and 34, having respective slit sections 36, 38, 40, and 42.

The slits 36 through 42 are cut at a 45° angle with respect to the diagonal of the opening 26 in the cloth. The opening 26 with the slits 36 through 42 therein, allows a folding backwardly of the tabs 28 through 34 interiorly of the opening 26 into the interior portion of the frame as it is constructed.

The fabric 24 is provided with normal rectangular corners at the outer portions thereof. However, the corners can be shaped around the periphery thereof, rounded, or provided with radial slits.

Figure 2:
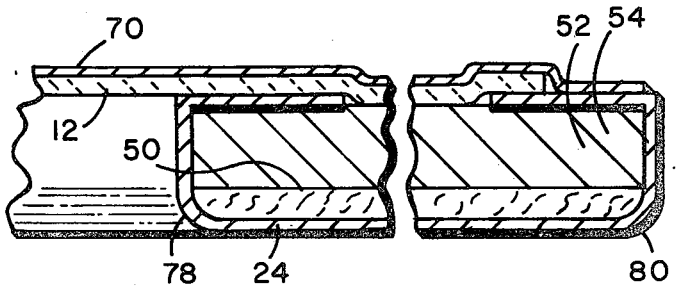
FIG. 2 shows a sectional view of a member of the frame along lines 2—2 of FIG. 1.

Looking more particularly at the exploded view of FIG. 3 and the cross sectional view of FIG. 2, it can be seen that a piece of foam material 50 is shown. The foam material 50 can be any resilient type of material, such as a polyurethane foam, sponge rubber, or other resilient material, such as a styrofoam, plastic, or a cellular structure. The foam should have sufficient resilience to allow a conformation in either a permanently or temporarily deformed state to provide the rounded smooth corners 16 through 22 of the frame 10.

The entire frame is applied over a chip board material 52. The chip board material 52 is formed as a frame backing or base and is of a relatively stiff type of material. The chip board material can be substituted by any other stiff material such as cardboard, plywood, plastic, or a composite.

The chip board 52 is covered with an adhesive 54. The adhesive 54 can be adhered in any suitable manner. In this particular instance, the adhesive 54 is shown applied to the back of the chip board 52 across its back surface. In applying the adhesive 54 to the back of the chip board 52, it can be initially applied in the form of tape with a release paper thereover.

In some cases, it has been found desirable to apply the adhesive 54 in the form of a double sided adhesive tape, such as that manufactured by Three M Corporation. In such a case, a double sided adhesive tape can be placed in the kit with release paper on each side thereof. A person making the frame then removes the release paper from one side of the adhesive and applies it to the periphery of the frame. Subsequently, the release paper is then withdrawn from the exposed back side of the frame so that the cloth 24 can be folded around the adhesive paper and adhered to the exposed back portion of the chip board back 52.

As previously stated, the tape or adhesive 54 can be provided by means of a double sided tape having adhesive on each surface thereof, such as is commonly manufactured and sold by Three M Company. Regardless of the way the adhesive is attached to the chip board 52, so that it interfaces the chip board with the cloth, it is felt that a wet glueing operation is generally not appropriate.

More particularly, a wet glueing operation tends to soak into the cloth 24 and cause a spreading of the glue to be absorbed and show at the edges or surface of the cloth. Thus, a dry type of adhesive should be applied without flow and wicking into the cloth 24. In the particular application as shown, it is thought that the most practical usage is with respect to a dry type of adhesive, such as that applied on a tape.

The entire adhesive 54 applied to the back surface of the chip board 52 serves to hold the cloth 24 tightly thereagainst when it is stretched around the chip board and the resilient foam 50. However, in some applications, it is desirable to place an adhesive between the other interfacing surfaces of the foam and the cloth or the foam and the chip board. As can be appreciated, the placement of adhesive or small adhering element between the chip board 52 and the foam 50, provides a fixation of the foam, so that it does not shift across the surface of the chip board in relationship to the cloth 24. However, in most applications, the aesthetic appearance of a billow or rounded resilient padded frame should be maintained.

As can be seen from the remaining portion of the drawings, an artistic rendering 12 has been adhered to the back of the frame. The artistic rendering 12 can be adhered to the back of the frame in any suitable manner, such as by adhesive or stretched and then glued. Additionally, an optional backing 70 can be provided. The backing 70 is only for purposes or providing a finished surface over the rear portion of the frame. Although the finished rear frame portion is not shown, it is found desirable in some particular cases to have a backing such as a piece of paper, cloth, or cardboard over the rear surfaces thereof.

Figure 4:
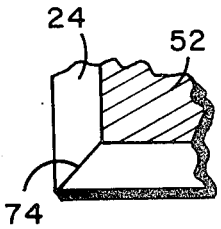
FIG. 4 shows a corner of the frame with its folded over portion thereof in the direction of lines 4—4 of FIG. 1; and, FIG. 5 shows a corner of the frame along lines 5—5 of FIG. 1 before the corner has been folded over.
Figure 5:
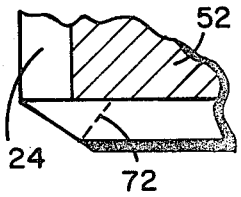

Looking more particularly at FIGS. 4 and 5, it can be seen wherein a process for adhering the cloth 24 to the rear of the frame is shown. Adhesion of the cloth 24 to the rear of the frame or chip board 52 is such that the chip board base and the cloth 24 is first of all folded over as in FIG. 5 and the underside tucked in within an alignment generally shown in the dotted underlying configuration 72.

After the above, the cloth 24 is then folded over on its upper surface to form a line 74 show in FIG. 4, so that the corner is then in smooth relationship to the entire back surface. Any particular type of adhesive can be utilized for folding and holding the cloth thereover. However, as can be appreciated, in some cases the cloth tabs will not adhere to the underside on a non-sticky substance, such as the flap shown in FIG. 5. As a consequence, it is sometimes desirable to place a small piece of adhesive at that particular point.

The result of the foregoing process and product manufactured therefrom, is to provide a frame 10 having round corners 16 through 22 and smooth rounded edge surfaces 78 and 80 that surround the entire frame structure. This enhances the body of the frame by providing a well formed resilient cushion-like surface over the frame and at the same time a smooth and appealing softened edge region 78 through 80 with corners 16 through 22 on the entire frame. As can be understood, this effectively creates a rounded conformation and a smooth appearance which is desirable in certain applications, such as those utilizing an artistic stitchery or needlework creation within the frame. As can be appreciated, the entire fabric and rounded smooth frame configuration takes on the appearance of an artistic creation in the entirety.

Although various glueing applications, adhesives in a dry or wet form can be utilized, and different foams, as well as applications of adhesive at the different interfaces, it is thought that the foregoing represents the preferred embodiment of the applicant's invention. However, other embodiments and variations can be derived from the teachings hereof. As a consequence, this invention is only to be construed and read in light of the following claims appended hereto.

I claim:

1. The improvement in a frame comprising:

a base member having a relatively stiff conformation with an opening for viewing an artistic rendering therein, a resilient deformable foam material conforming substantially to the size and shape of said base member and overlaid on the face of said base; and, a cloth material overlying said foam and wrapped around the interior edges defined by said opening and around said peripheral edges and secured to the underside of said base in a snug manner by an adhesive adhered to the underside of said base member and between the base member and the wrapped material overlying the underside thereof.

2. The frame as claimed in claim 1 wherein:

said adhesive is applied to the back side of said base member in the form of a tape having two adhesive surfaces thereon.

3. The frame as claimed in claim 2 wherein:

said adhesive is initially applied to the back side of said base member with a release tape thereover.

4. The frame as claimed in claim 1 wherein:

said base member is formed from a chip board.

5. The frame as claimed in claim 1 further comprising:

an adhesive interfaced between the foam material and the face of the base member.

6. The frame as claimed in claim 5 further comprising:

an adhesive adhered between the interface of the cloth and the foam material.

* * * * *